US006058508A

United States Patent [19]

Brown Honeysuckle

[11] Patent Number: 6,058,508

[45] Date of Patent: May 9, 2000

[54] ADJUSTABLE GARMENT

[76] Inventor: Jelane N. Brown Honeysuckle, 4307 Kingswick Dr., Arlington, Tarrant County, Tex. 76016

[21] Appl. No.: 09/179,518

[22] Filed: Oct. 26, 1998

[51] Int. Cl.[7] ..... A41B 1/12

[52] U.S. Cl. ..... 2/69; 2/80

[58] Field of Search ..... 2/69, 75, 86, 269, 2/270, 69.5, 78.1, 79, 74, 80, 83, 105, 85, 93, 108, 102

[56] References Cited

U.S. PATENT DOCUMENTS

| | | | |
|---|---|---|---|
| 1,491,767 | 4/1924 | Freedman . | |
| 2,051,444 | 8/1936 | Haister | 2/76 |
| 2,085,179 | 6/1937 | Badantes | 2/74 |
| 2,442,494 | 6/1948 | Hopkins | 2/75 |
| 2,492,396 | 12/1949 | Perlitch | 2/74 |
| 2,493,545 | 1/1950 | Muyleart | 2/70 |
| 2,507,463 | 5/1950 | Smith | 2/69 |
| 2,580,024 | 12/1951 | Hoffman | 2/69 |
| 2,602,163 | 7/1952 | Davenport | 2/75 |
| 2,714,718 | 8/1955 | Kramer | 2/70 |
| 2,717,395 | 9/1955 | Holshouser | 2/243 |
| 2,722,010 | 11/1955 | Thielman | 2/76 |
| 2,725,565 | 12/1955 | Wyner | 2/69 |
| 3,064,265 | 11/1962 | Bridgewaters | 2/74 |
| 3,106,717 | 10/1963 | Cuvin | 2/69 |
| 3,111,681 | 11/1963 | Nelson et al. | 2/69 |
| 3,665,516 | 5/1972 | Orovan | 2/74 |
| 4,573,218 | 3/1986 | Saggs | 2/93 |
| 4,683,595 | 8/1987 | Cash | 2/105 |
| 4,697,288 | 10/1987 | Palumbo | 2/269 |
| 5,539,932 | 7/1996 | Howard | 2/269 |
| 5,708,977 | 1/1998 | Morkunas | 2/80 |

*Primary Examiner*—Diana Oleksa
*Assistant Examiner*—Katherine Moran
*Attorney, Agent, or Firm*—Baker Botts L.L.P.

[57] ABSTRACT

An adjustable garment includes an article of clothing having a first fastener element defining a first portion and a second portion of the article of clothing. The adjustable garment also includes a second fastener element associated with the article of clothing disposed a predetermined distance from the first fastener element. The second fastener element defines a third portion of the article of clothing adjacent the second portion. The second fastener element is operable to associate with the first fastener element to allow ready attachment of the first portion to the third portion. The second fastener element is further operable to disassociate from the first fastener element to allow ready detachment of the first portion from the third portion.

41 Claims, 5 Drawing Sheets

ADJUSTABLE GARMENT

TECHNICAL FIELD OF THE INVENTION

This invention relates generally to clothing and, more particularly, to an adjustable garment.

BACKGROUND OF THE INVENTION

Garments are generally designed and fabricated to accommodate a particular size or type of individual. For example, one particular size of an infant's garment may be designed to accommodate an infant at generally 24 months of age. Thus, the infant's garment is designed and fabricated to accommodate an infant having physical measurements generally equal to the physical measurements of a majority of infants at 24 months of age.

However, physical measurements of individuals are subject to change over time, especially the physical measurements of children. For example, an infant may experience a substantial increase in length in a matter of weeks. As a result, the infant can rapidly outgrow recently purchased articles of clothing making those articles of clothing obsolete.

Additionally, for example, maternity produces similar conditions. Expectant mothers experience changes in physical proportions before and after childbirth. Several different sizes and types of garments are generally required to accommodate changes in physical proportions throughout maternity. As a result, a large quantity of types and sizes of garments are required throughout maternity, resulting in costly additions to an individual's wardrobe. Additionally, garments purchased for maternity may become obsolete during maternity due to changes in the physical proportions of the individual throughout maternity.

SUMMARY OF INVENTION

Accordingly, a need has arisen for an improved adjustable garment that provides increased flexibility. The present invention provides an adjustable garment that addresses shortcomings of prior adjustable garments and increases flexibility.

According to one embodiment of the invention, an adjustable garment includes a first fastener element associated with an article of clothing. The first fastener element defines a first portion and a second portion of the article of clothing. The adjustable garment also includes a second fastener element associated with the article of clothing disposed a predetermined distance from the first fastener element. The second fastener element defines a third portion of the article of clothing adjacent the second portion. The second fastener element is operable to associate with the first fastener element to allow ready attachment of the first portion to the third portion. The second fastener element is further operable to disassociate from the first fastener element to allow ready detachment of the first portion from the third portion.

According to another embodiment of the invention, a method for fabricating an adjustable garment includes associating a first fastener element with an article of clothing defining a first portion and a second portion of the article of clothing. The method also includes associating a second fastener element with the article of clothing a predetermined distance from the first fastener element defining a third portion of the article of clothing adjacent the second portion. The second fastener element is operable to associate with the first fastener element allowing ready attachment of the first portion to the third portion. The second fastener element is further operable to disassociate from the first fastener element allowing ready detachment of the first portion from the third portion.

The invention provides several technical advantages. For example, in one embodiment of the invention, the adjustable garment provides greater flexibility than prior adjustable garments by accommodating increases in length of an individual in a substantially short amount of time. In the same embodiment, the adjustable garment may be decreased in length to accommodate another individual or to accommodate a reduction in physical proportions of an individual.

Other technical advantages will be readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which like reference numbers indicate like features and wherein.

DETAILED DESCRIPTION OF THE INVENTION

Figure 1:
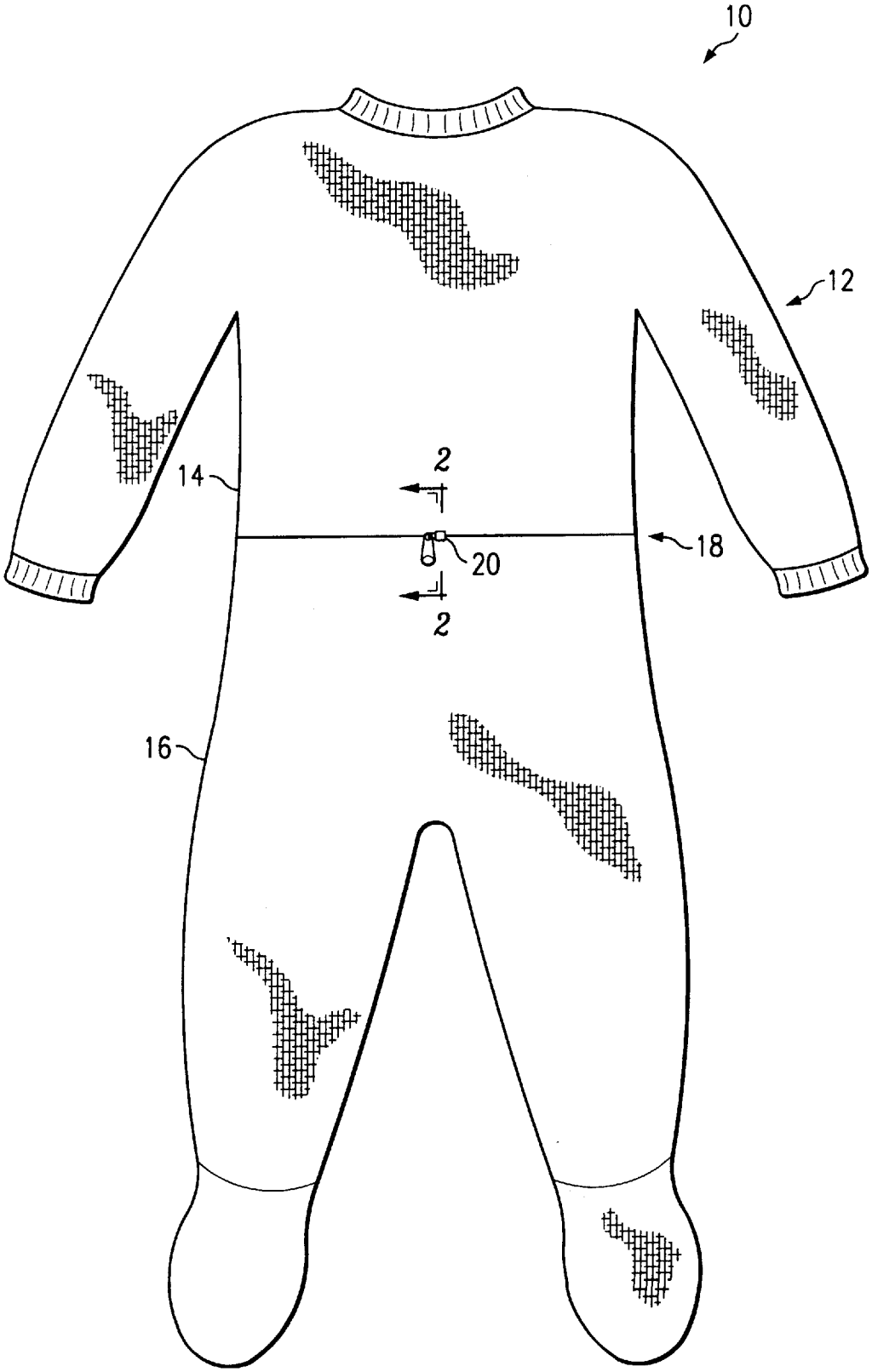
FIG. 1 is a drawing of a front view of an adjustable garment constructed in accordance with the present invention.

FIG. 1 is a drawing illustrating a front view of one embodiment of an adjustable garment 10 constructed according to the teachings of the present invention. Adjustable garment 10 includes an article of clothing 12 having an upper portion 14 and a lower portion 16. Adjustable garment 10 also includes a fastener 18 for joining or attaching upper portion 14 to lower portion 16. For clarity, FIG. 1 illustrates adjustable garment 10 in a non-extended configuration. The adjustable features of adjustable garment 10 will be further described in conjunction with FIGS. 2A through 5.

In the embodiment illustrated in FIG. 1, article of clothing 12 includes an infant's layette; however, other suitable types of clothing may also be used for adjustable garment 10, such as maternity clothing, uniforms, or other types of clothing. For example, the teachings of the present invention, as will be further described in conjunction with FIGS. 2A through 5, may be incorporated into maternity clothing allowing adjustable garment 10 to accommodate changes in physical proportions of an individual during and after pregnancy.

Additionally, for clarity, adjustable garment 10 is illustrated in FIG. 1 without zippers, snaps, or other types of fastening devices for opening and placing article of clothing 12 on an individual. However, fastening devices for opening and placing article of clothing 12 on an individual may be readily incorporated into article of clothing 12 by those of ordinary skill.

Fastener 18 of adjustable garment 10, in the embodiment illustrated in FIG. 1, includes a separating zipper 20 circumferentially disposed on article of clothing 12. However, other suitable types of fasteners 18 may also be used with adjustable garment 10 for joining or attaching upper portion 14 to lower portion 16, such as snaps, clips, hooks and eyes, string and eyes, Velcro strips, buttons and buttonholes, and the like. In operation, as will be further described in conjunction with FIGS. 2A through 5, fastener 18 may be readily disengaged or re-engaged providing an increase or decrease, respectively, in length of adjustable garment 10. Additionally, fastener 18 may also be disposed at other suitable locations and orientations on article of clothing 12 to accommodate clothing adjustments in other areas of article of clothing 12, such as waist or outer seam adjustments.

Figure 2A:
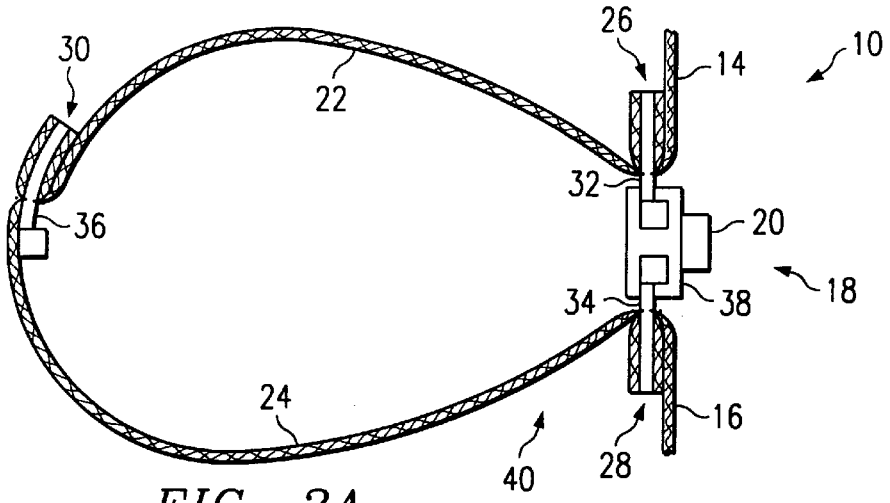
FIG. 2A is a cross-sectional view of the adjustable garment of FIG. 1 taken generally along the line 2—2 of FIG. 1.

FIG. 2A is a cross-sectional view of adjustable garment 10 shown in FIG. 1 taken generally along the line 2—2 of FIG. 1. As illustrated in FIG. 2A, adjustable garment 10 includes upper portion 14, lower portion 16, and central portions 22 and 24. Although adjustable garment 10 is shown in FIG. 2A having two central portions 22 and 24, adjustable garment 10 may be constructed having a variety of quantities of central portions 22 and 24. For example, adjustable garment 10 may be constructed having a single central portion 22 or 24 providing for a single extended or adjusted configuration. However, adjustable garment may also be constructed having additional central portions 22 or 24 providing additional adjustment configurations of adjustable garment 10.

As illustrated in FIG. 2A, fastener 18 includes a fastener element 26 associated with upper portion 14 and a fastener element 28 associated with lower portion 16. Adjustable garment 10 also includes a fastener element 30 associated with central portions 22 and 24. As previously described in conjunction with FIG. 1, fastener 18 illustrated in the embodiment shown in FIG. 2A includes separating zipper 20. Thus, fastener elements 26, 28, and 30 of fastener 18 include zipper strips 32, 34, and 36, respectively.

Adjustable garment 10 is illustrated in a non-extended position in FIG. 2A. In the non-extended position, fastener element 26 associates or couples with fastener element 28 to attach lower portion 16 to upper portion 14. For example, fastener element 26 may be connected to fastener element 28 to dispose lower portion 16 adjacent upper portion 14. In the embodiment illustrated in FIG. 2A, zipper strips 32 and 34 of separating zipper 20 are joined or coupled using a slider 38. Additionally, in the non-extended position illustrated in FIG. 2A, central portions 22 and 24 are concealed within an interior area 40 of adjustable garment 10. Thus, central portions 22 and 24 and fastener element 30 are concealed from view while adjustable garment 10 is worn by an individual in the non-extended position.

As illustrated in FIG. 2A, upper portion 14, central portions 22 and 24, and lower portion 16 of article of clothing 12 include several pieces of clothing material coupled together to form adjustable garment 10. For example, upper portion 14 and central portion 22 are coupled together by sewing or stitching upper portion 14 to a forwardly facing surface of fastener element 26 and sewing or stitching central portion 22 to a rearwardly facing surface of fastener element 26. However, other methods or devices may be used to form adjustable garment 10 using several pieces of clothing material.

Figure 2B:
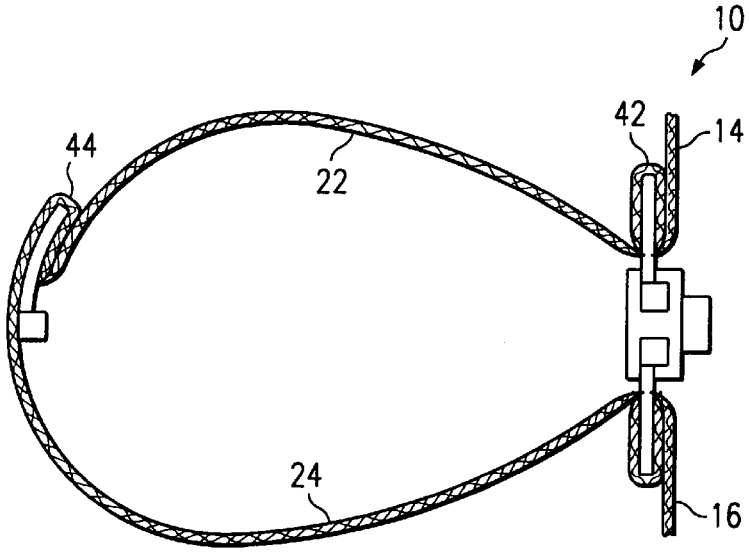
FIG. 2B is a cross-sectional view of the adjustable garment of FIG. 1 taken generally along the line 2—2 of FIG. 1 illustrating an alternate embodiment of the adjustable garment.

FIG. 2B is a cross-sectional view taken generally along the line 2—2 of FIG. 1 illustrating an alternate embodiment of adjustable garment 10. In this embodiment, upper portion 14, central portions 22 and 24, and lower portion 16 include a single piece of clothing material used to form adjustable garment 10. For example, fastener element 26 is disposed within a loop or fold 42 formed using upper portion 14 and central portion 22. As illustrated in FIG. 2B, fastener element 26 is secured within fold 42 by stitching or sewing fastener element 26 within fold 42; however, other suitable methods or devices for securing fastener element 26 within fold 42 may be used.

Additionally, fastener element 30 is disposed within a loop or fold 44 formed using central portions 22 and 24. As illustrated in FIG. 2B, fastener element 30 is secured within fold 44 by sewing or stitching fastener element 30 within fold 44. Therefore, adjustable garment 10 may be constructed using a variety of techniques, such as constructing adjustable garment 10 from a single piece of clothing material or constructing adjustable garment 10 from several pieces of clothing material.

Moreover, as illustrated in FIGS. 2A and 2B, fastener elements 26, 28, and 30 may be secured to adjustable garment 10 using a variety of techniques. For example, as best illustrated in FIG. 2B, both forwardly and rearwardly facing surfaces of fastener element 26 are secured to article of clothing 12. Alternatively, only a single surface of fastener elements 26, 28 and 30 may be used to secure fastener elements 26, 28 and 30 to article of clothing 12. For example, the forwardly facing surface of fastener element 30 is used to secure fastener element 30 to article of clothing 12. Thus, adjustable garment 10 provides greater flexibility than prior adjustable garments by providing for a variety of techniques for constructing adjustable garment 10.

Figure 3:
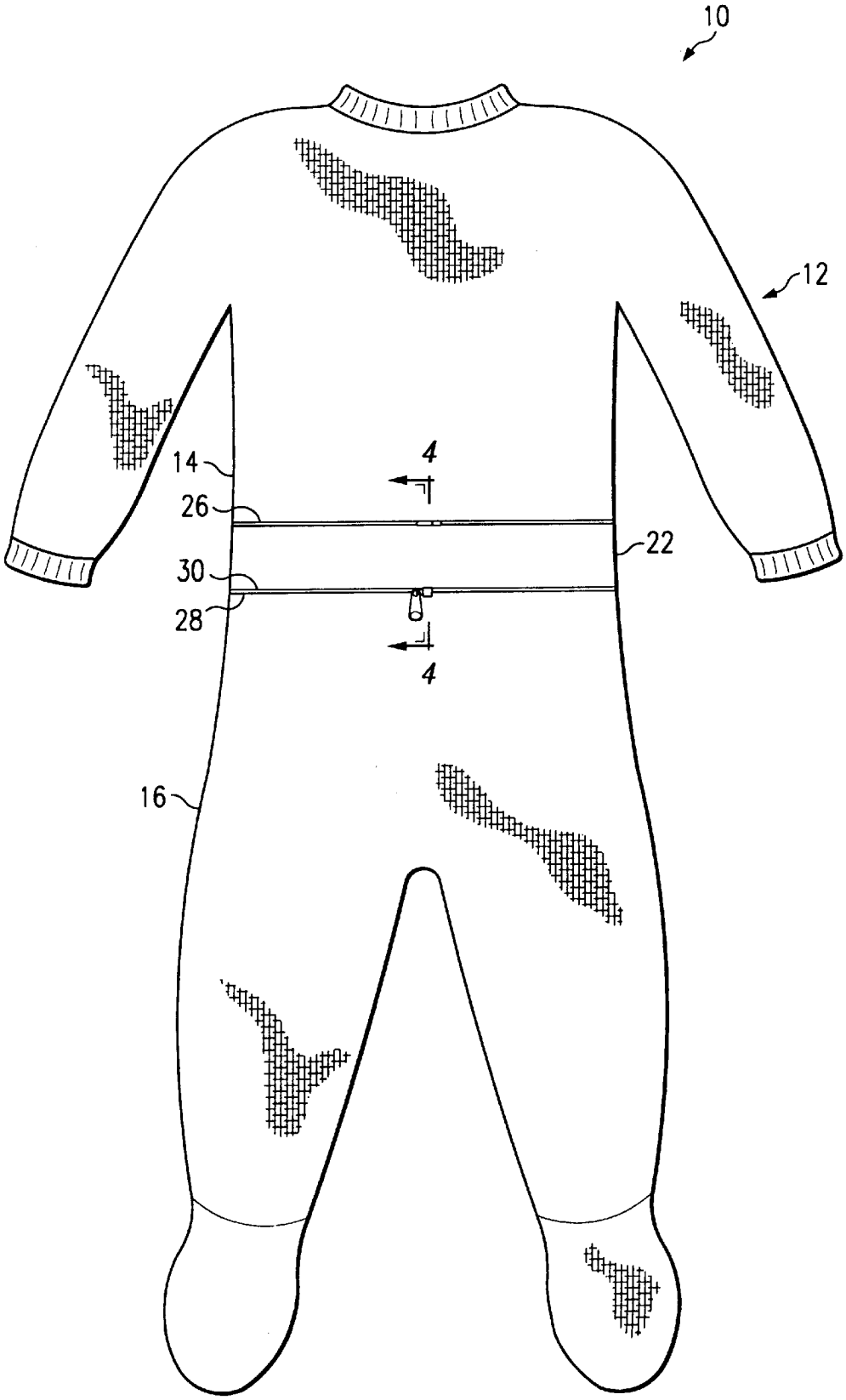
FIG. 3 is a drawing of a front view of the adjustable garment shown in FIG. 1 in a first extended configuration.

FIG. 3 is a drawing illustrating a front view of adjustable garment 10 in a first extended position. As illustrated in FIG. 3, fastener element 26 is disassociated or disconnected from fastener element 28 thereby revealing central portion 22 from within interior area 40 of adjustable garment 10. For example, slider 38 is used to readily disengage zipper strip 32 from zipper strip 34. Additionally, fastener element 28 is associated or coupled with fastener element 30 so that central portion 24 remains concealed within interior area 40 of adjustable garment 10. For example, slider 38 is used to readily engage zipper strip 28 with zipper strip 30. Thus, the length of adjustable garment 10 has been increased by an amount equal to the length of central portion 22 as measured from fastener element 26 to fastener element 30. The operation of adjustable garment 10 will be further described in conjunction with FIG. 4.

Figure 4:
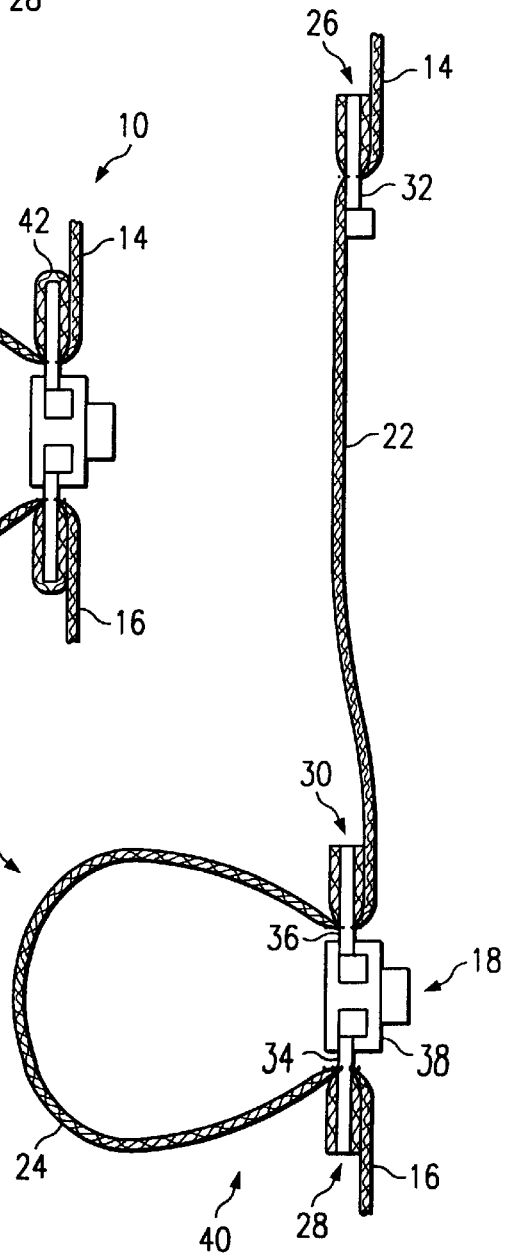
FIG. 4 is a cross-sectional view of the adjustable garment of FIG. 3 taken generally along the line 4—4 of FIG. 3.

FIG. 4 is a cross-sectional view of adjustable garment 10 shown in FIG. 3 taken generally along the line 4—4 of FIG. 3. As illustrated in FIG. 4, fastener element 28 is associated with fastener element 30, thereby revealing central portion 22 from within interior area 40 of adjustable garment 10. As illustrated in FIG. 4, central portion 24 remains concealed within interior area 40 of adjustable garment 10. Therefore, the length of adjustable garment 10 has been increased by an amount equal to the length of central portion 22 as measured from fastener element 26 to fastener element 30.

In operation, as illustrated in FIG. 4, zipper strip 32 is readily disassociated from zipper strip 34 using slider 38. Slider 38 is then used to readily associate fastener element 28 with fastener element 30 to obtain the first extended position of adjustable garment 10 illustrated in FIG. 4. As previously described in conjunction with FIGS. 2A and 2B, fastener 18 may include separating zipper 20 or other suitable types of devices for joining clothing material, such as snaps, clips, hooks and eyes, string and eyes, Velcro strips, and the like.

Additionally, adjustable garment 10 may be readily decreased in length by reversing the above-described operation. For example, zipper strip 34 may be readily disassociated from zipper strip 36 using slider 38. Slider 38 may then be used to readily associate zipper strip 28 with zipper strip 32, thereby resulting in the configuration of adjustable garment 10 illustrated in FIGS. 2A and 2B. Thus, adjustable garment 10 provides greater flexibility than prior adjustable garments by allowing ready adjustment of adjustable garment 10 within a generally short amount of time.

Figure 5:
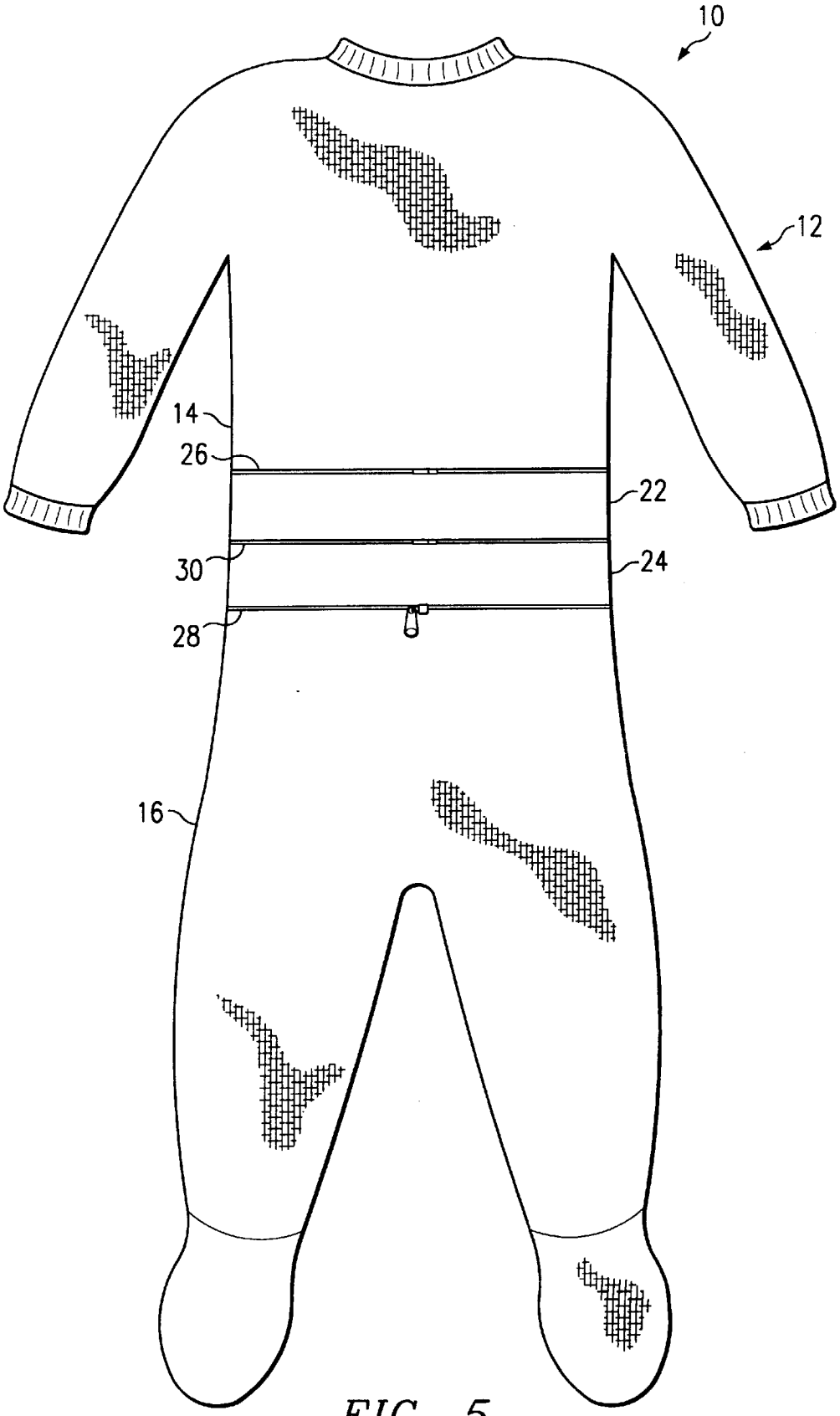
FIG. 5 is drawing of a front view of the adjustable garment shown in FIG. 3 in a second extended configuration.

FIG. 5 is a drawing illustrating a front view of adjustable garment 10 in a second extended or adjusted position. As illustrated in FIG. 5, fastener element 28 has been disassociated from fastener element 30, thereby revealing central portions 22 and 24 from within interior area 40 of adjustable garment 10. Therefore, adjustable garment 10 has been increased in length an amount equal to the length of central portions 22 and 24 as measured from fastener element 26 to fastener element 28.

As best illustrated in FIG. 5, fastener element 30 is disposed on article of clothing 12 a predetermined distance from fastener element 26. Additionally, fastener element 28 is disposed on article of clothing 12 a predetermined distance from fastener element 30. Thus, fastener elements 26, 28 and 30 define different areas or portions of adjustable garment 10. For example, fastener element 26 defines a boundary between upper portion 14 and central portion 22. Therefore, the predetermined distances between fastener elements 26, 28 and 30 may be selected to accommodate a variety of adjustment configurations. For example, the predetermined distances between fastener elements 26, 28 and 30 may be selected to be substantially equal to one another to obtain substantially equal increases or decreases in length of adjustable garment 10. Additionally, for example, the predetermined distance between fastener elements 26 and 30 may be selected to be greater or less than the predetermined distance between fastener elements 28 and 30, thereby providing for a variety of adjustment configurations.

Therefore, adjustable garment 10 provides greater flexibility than prior adjustable garments by allowing the length of adjustable garment 10 to be readily increased or decreased to accommodate changes in physical proportions of an individual or to accommodate another individual. For example, fastener element 28 may be readily associated or disassociated from fastener elements 26 and 30 to decrease or increase the length of adjustable garment 10. Thus, a single adjustable garment 10 may be worn by several different individuals of varying length or height.

Figure 6:
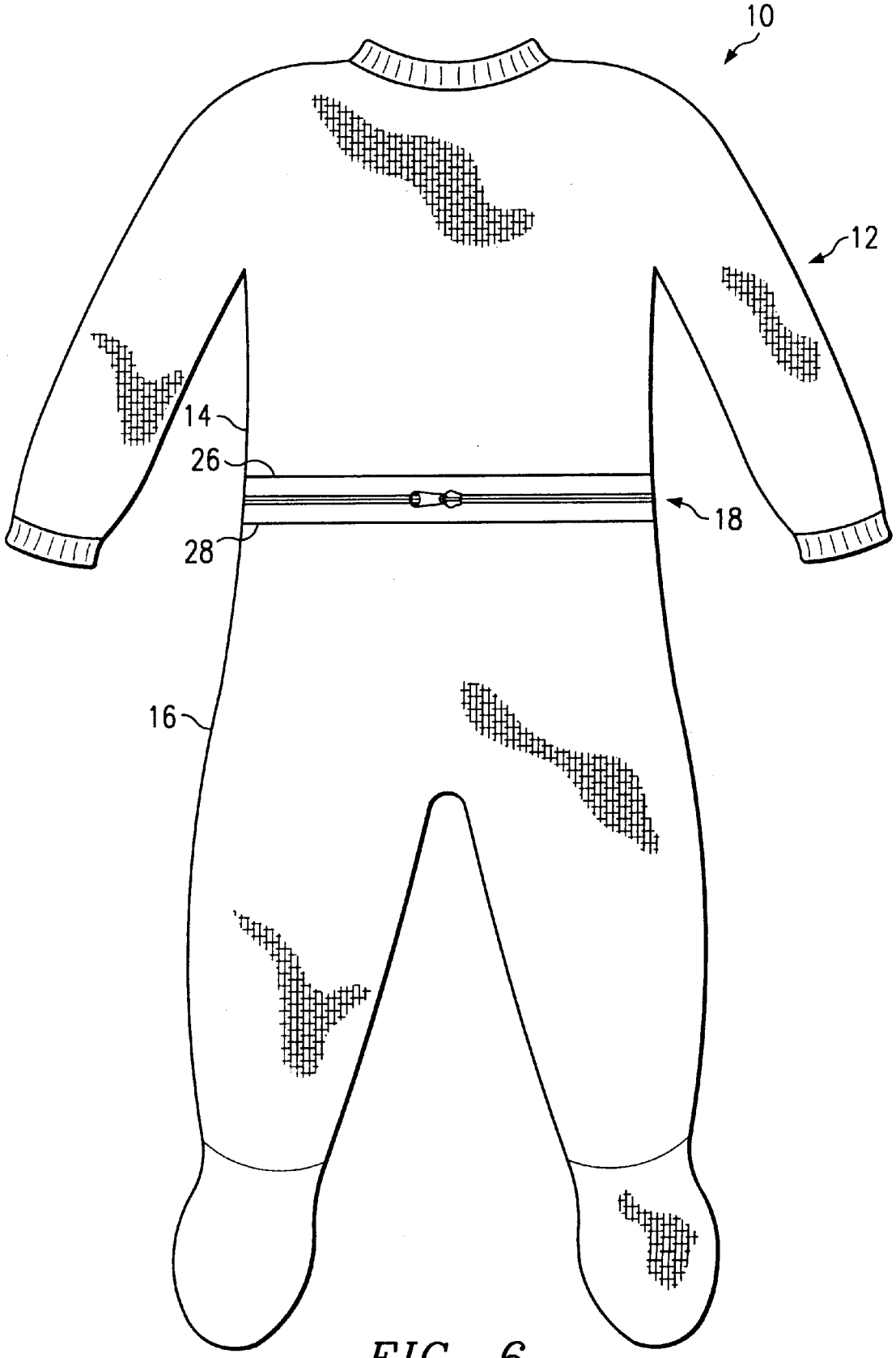
FIG. 6 is a drawing of a front view of an alternate embodiment of the adjustable garment.

FIG. 6 is a drawing illustrating a front view of an alternate embodiment of adjustable garment 10. In this embodiment, fastener elements 26 and 28 are attached to article of clothing 12 so that the forwardly facing surfaces of fastener elements 26 and 28 are visible to an individual viewing adjustable garment 10. For example, referring to FIG. 2A, upper portion 14 and lower portion 16 conceal a majority of the forwardly facing surfaces of fastener elements 26 and 28, respectively, within interior area 40 of adjustable garment 10. Referring to FIG. 6, upper portion 14 and lower portion 16 are coupled to fastener elements 26 and 28, respectively, so that the forwardly facing surfaces of fastener elements 26 and 28 are visible to an individual viewing adjustable garment 10. Thus, fastener elements 26 and 28 may be used to provide additional clothing design considerations of adjustable garment 10, such as varying color schemes, or providing a location for clothing or character trademarks. Thus, adjustable garment 10 provides greater flexibility than prior adjustable garments by accommodating a variety of design considerations.

Additionally, although FIGS. 1 through 6 illustrate the teachings of the present invention incorporated into an infant's layette, adjustable garment 10 may also be used in other clothing applications. For example, adjustable garment 10 may include maternity wear to accommodate changes in physical measurements of an individual during and after pregnancy. For example, fastener elements 26, 28 and 30 may be circumferentially disposed on various areas of article of clothing 12 to accommodate increases in physical measurements during maternity. Additionally, fastener elements 26, 28 and 30 may also be disposed at other locations and at various orientations on article of clothing 12. For example, fastener elements 26, 28 and 30 may be disposed vertically on a rearwardly facing surface of article of clothing 12.

Further, the teachings of the present invention may also be incorporated into clothing applications requiring repeated use by different individuals, such as uniforms, rented tuxedos, costumes, emergency clothing, and the like. For example, fastener elements 26, 28 and 30 may be disposed along an outer seam of a pair of trousers extending vertically from a waistline to a cuff of the pair of trousers. Thus, adjustable garment 10 may be used to accommodate changes in physical proportions other than length, such as waistline adjustments. Therefore, adjustable garment 10 provides greater flexibility than prior adjustable garments by accommodating a variety of physical proportions by locating fastener elements 26, 28 and 30 at different locations and orientations on article of clothing 12.

Additionally, the teachings of the present invention may be used on any seam or location of article of clothing 12 to increase or decrease any dimension of article of clothing 12. For example, fastener elements 26, 28 and 30 may be disposed at various locations of article of clothing 12 to accommodate dimensional changes of an individual such as leg length, leg circumference, arm length, arm circumference, or the circumference of the trunk of the individual. For example, fastener elements 26, 28 and 30 may be disposed along a seam of an arm of article of clothing 12 to accommodate dimensional changes in the arm circumference of an individual. Thus, adjustable garment 10 provides greater flexibility than prior adjustable garments by accommodating a variety of dimensional changes of one or more individuals.

Although the present invention and its advantages have been described in detail, it should be understood that various changes, substitutions, and alteration, can be made therein without departing from the spirit and scope of the present invention as defined by the appended claims.

What is claimed is:

1. An adjustable garment comprising:

an article of clothing;

a first fastener element associated with the article of clothing, the first fastener element defining a first portion and a second portion of the article of clothing, the first and second portions comprising adjacent portions of a single piece of clothing material; and a second fastener element associated with the article of clothing disposed a predetermined distance from the first fastener element, the second fastener element defining a third portion of the article of clothing adjacent the second portion, the second fastener element operable to associate with the first fastener element to allow ready attachment of the first portion to the third portion, the second fastener element further operable to disassociate from the first fastener element to allow ready detachment of the first portion from the third portion.

2. The garment of claim 1, wherein the second and third portions comprise adjacent portions of the single piece of clothing material.

3. The adjustable garment of claim 2, wherein a portion of the second fastener element is disposed within a fold formed in the single piece of fabric material.

4. The garment of claim 1, wherein the first and second fastener elements comprise separating zipper strips.

5. The garment of claim 1, wherein the first and second fastener elements comprise hook and loop strips.

6. The garment of claim 1, wherein the first fastener element comprises buttons, and wherein the second fastener element comprises buttonholes.

7. The garment of claim 1, wherein the first and second fastener elements are circumferentially disposed with respect to the article of clothing.

8. The adjustable garment of claim 1, wherein a portion of the first fastener element is disposed within a fold formed in the single piece of fabric material.

9. An adjustable garment comprising:

an article of clothing;

a first fastener element associated with the article of clothing, the first fastener element defining a first portion and a second portion of the article of clothing;

a second fastener element associated with the article of clothing disposed a predetermined distance from the first fastener element, the second fastener element defining a third portion of the article of clothing adjacent the second portion, the second fastener element operable to associate with the first fastener element to allow ready attachment of the first portion to the third portion, the second fastener element further operable to disassociate from the first fastener element to allow ready detachment of the first portion from the third portion; and a third fastener element coupled to the article of clothing, the third fastener element defining a fourth portion of the article of clothing adjacent the third portion, the third fastener element operable to associate with the first fastener element allowing ready attachment of the fourth portion to the first portion, the third fastener element further operable to disassociate from the first fastener element allowing ready detachment of the fourth portion from the first portion.

10. The garment of claim 9, wherein the third fastener element is further operable to associate with the second fastener element allowing ready attachment of the fourth portion to the second portion, the third fastener element further operable to disassociate from the second fastener element allowing ready detachment of the fourth portion from the second portion.

11. The garment of claim 9, wherein the first, second, and third fastener elements comprise separating zipper strips.

12. The adjustable garment of claim 9, wherein the first and second portions comprise adjacent portions of a single piece of clothing material.

13. The adjustable garment of claim 12, wherein a portion the first fastener element is disposed within a fold formed in the single piece of clothing material.

14. The adjustable garment of claim 12, wherein the second and third portions comprise adjacent portions of the single piece of clothing material.

15. The adjustable garment of claim 14, wherein the third and fourth portions comprise adjacent portions of the single piece of clothing material.

16. A method for fabricating an adjustable garment comprising:

associating a first fastener element with an article of clothing, the first fastener element defining a first portion and a second portion of the article of clothing, the first and second portions comprising adjacent portions of a single piece of clothing material; and associating a second fastener element with the article of clothing a predetermined distance from the first fastener element, the second fastener element defining a third portion of the article of clothing adjacent the second portion, wherein the second fastener element is operable to associate with the first fastener element allowing ready attachment of the first portion to the third portion, the second fastener element further operable to disassociate from the first fastener element allowing ready detachment of the first portion from the third portion.

17. The method of claim 16, wherein the step of associating a first fastener element comprises attaching a first separating zipper strip, and wherein the step of associating a second fastener element comprises attaching a second separating zipper strip.

18. The method of claim 16, wherein the step of associating a first fastener element comprises attaching a hook portion of a hook and loop strip, and wherein the step of associating a second fastener element comprises attaching a loop portion of the hook and loop strip.

19. The method of claim 16, wherein the step of associating a first fastener element comprises attaching a plurality of buttons, and wherein the step of associating a second fastener element comprises creating a plurality of buttonholes.

20. The method of claim 16, wherein the step of associating a first fastener element comprises circumferentially associating a first fastener element with respect to the article of clothing, and wherein the step of associating a second fastener element comprises circumferentially associating a second fastener element with respect to the article of clothing.

21. The method of claim 16, wherein associating the first fastener element comprises:

forming a fold in the single piece of clothing material between the first and second portions;

disposing a portion of the first fastener element within the fold; and coupling the portion of the first fastener element to the single piece of clothing material.

22. The method of claim 16, wherein the second and third portions comprise adjacent portions of the single piece of fabric material.

23. The method of claim 22, wherein associating the second fastener element comprises:

forming a fold in the single piece of clothing material between the second and third portions;

disposing a portion of the second fastener element within the fold; and coupling the portion of the second fastener element to the single piece of clothing material.

24. A method for fabricating an adjustable garment comprising:

associating a first fastener element with an article of clothing, the first fastener element defining a first portion and a second portion of the article of clothing;

associating a second fastener element with the article of clothing a predetermined distance from the first fastener element, the second fastener element defining a third portion of the article of clothing adjacent the second portion, wherein the second fastener element is operable to associate with the first fastener element allowing ready attachment of the first portion to the third portion, the second fastener element further operable to disassociate from the first fastener element allowing ready detachment of the first portion from the third portion; and associating a third fastener element with the article of clothing, the third fastener element defining a fourth portion of the article of clothing adjacent the third portion, wherein the third fastener element is operable to associate with the first fastener element allowing ready attachment of the fourth portion to the first portion, the third fastener element further operable to disassociate from the first fastener element allowing ready detachment of the first portion from the fourth portion.

25. The method of claim 24, wherein the first and second portions comprise adjacent portions of a single piece of clothing material.

26. The method of claim 25 wherein associating the first fastener element comprises:

forming a fold in the single piece of clothing material between the first and second portions;

disposing a portion of the first fastener element within the fold; and coupling the portion of the first fastener element to the single piece of clothing material.

27. The method of claim 24, wherein the first, second and third fastener elements are circumferentially disposed about a portion of the article of clothing.

28. An adjustable garment comprising:

an article of clothing having a first portion, a second portion, and a third portion, wherein the third portion is disposed between the first and second portions, and wherein the first and third portions comprise adjacent portions of a single piece of clothing material;

a first fastener element coupled to the article of clothing between the first and third portions; and a second fastener element coupled to the article of clothing between the second and third portions, the second fastener element operable to readily associate with the first fastener element to conceal the third portion within an interior area of the garment, the second fastener element further operable to readily disassociate from the first fastener element to reveal the third portion.

29. The garment of claim 28, wherein the first and second fastener elements comprise snaps.

30. The garment of claim 28, wherein the second and third portions comprise adjacent portions of the single piece of clothing material.

31. The adjustable garment of claim 30, wherein a portion of the second fastener element is disposed within a fold formed between the second and third portions.

32. The garment of claim 28, wherein the first and second fastener elements are circumferentially disposed with respect to the article of clothing.

33. The adjustable garment of claim 28, wherein a portion of the first fastener element is disposed within a fold formed between the first and third portions.

34. An adjustable garment comprising:

an article of clothing having a first portion, a second portion, a third portion, and a fourth portion, wherein the third portion is disposed between the first and second portions, and wherein the second portion is disposed between the third and fourth portions;

a first fastener element coupled to the article of clothing between the first and third portions;

a second fastener element coupled to the article of clothing between the second and third portions, the second fastener element operable to readily associate with the first fastener element to conceal the third portion within an interior area of the garment, the second fastener element further operable to readily disassociate from the first fastener element to reveal the third portion; and a third fastener element coupled to the article of clothing between the second and fourth portions, the third fastener element operable to readily associate with the first fastener element to conceal the second and third portions within the interior area of the garment, the third fastener element further operable to readily disassociate from the first fastener element to reveal the second and third portions.

35. The adjustable garment of claim 34, wherein the first, second, third and fourth portions comprise adjacent portions of a single piece of clothing material.

36. The adjustable garment of claim 35, wherein a portion of the first fastener element is disposed within a fold formed between the first and third portions.

37. The adjustable garment of claim 34, wherein:

a portion of the first fastener element is disposed within a first fold formed between the first and third portions;

a portion of the second fastener element is disposed within a second fold formed between the second and third portions; and a portion of the third fastener element is disposed within a third fold formed between the second and fourth portions.

38. An adjustable garment comprising:

an article of clothing having an interior surface and an exterior surface;

a first fastener element having a forwardly facing surface and a rearwardly facing surface, the rearwardly facing surface of the first fastener element coupled to the exterior surface of the article of clothing to define a first portion and a second portion of the article of clothing; and a second fastener element having a forwardly facing surface and a rearwardly facing surface, the rearwardly facing surface of the second fastener element coupled to the exterior surface of the article of clothing a predetermined distance from the first fastener element to define a third portion of the article of clothing adjacent the second portion, the second fastener ele ment operable to associate with the first fastener element to allow ready attachment of the first portion to the third portion, the second fastener element further operable to disassociate from the first fastener element to allow ready detachment of the first portion from the third portion.

39. The adjustable garment of claim 38, wherein the first and second fastener elements are circumferentially disposed with respect to the article of clothing.

40. The adjustable garment of claim 38, wherein the first and second portions comprise adjacent portions of a single piece of clothing material.

41. The adjustable garment of claim 40, wherein the second and third portions comprise adjacent portions of the single piece of clothing material.

* * * * *